US009733620B2

(12) United States Patent
Karapatis et al.

(10) Patent No.: US 9,733,620 B2
(45) Date of Patent: Aug. 15, 2017

(54) STRIKING MECHANISM FOR A WATCH OR MUSIC BOX WITH A VIBRATION PLATE HAVING OPTIMISED ACTUATION ENERGY

(71) Applicant: Montres Breguet S.A., L'Abbaye (CH)

(72) Inventors: Polychronis Nakis Karapatis, Premier (CH); Younes Kadmiri, Morre (FR); Davide Sarchi, Renens (CH)

(73) Assignee: Montres Breguet SA, L'Abbaye (CH)

( * ) Notice: Subject to any disclaimer, the term of this patent is extended or adjusted under 35 U.S.C. 154(b) by 0 days.

(21) Appl. No.: 15/102,182

(22) PCT Filed: Nov. 26, 2014

(86) PCT No.: PCT/EP2014/075613
§ 371 (c)(1),
(2) Date: Jun. 6, 2016

(87) PCT Pub. No.: WO2015/086317
PCT Pub. Date: Jun. 18, 2015

(65) Prior Publication Data

US 2016/0306325 A1 Oct. 20, 2016

(30) Foreign Application Priority Data

Dec. 9, 2013 (EP) ..... 13196157

(51) Int. Cl.
*G04B 21/08* (2006.01)
*G04B 23/00* (2006.01)
(Continued)

(52) U.S. Cl.
CPC ..... *G04B 21/08* (2013.01); *G04B 23/005* (2013.01); *G04B 23/08* (2013.01); *G10F 1/06* (2013.01); *G10K 1/067* (2013.01)

(58) Field of Classification Search
CPC ..... G10F 1/06; G10K 1/067; G04B 21/02; G04B 23/00; G04B 21/08; G04B 23/08; G04B 23/005
See application file for complete search history.

(56) References Cited

U.S. PATENT DOCUMENTS 2,876,670 A * 3/1959 Duncan ..... G10F 1/06 84/94.1
5,523,523 A * 6/1996 Chen ..... G10F 1/06 446/298

(Continued)

FOREIGN PATENT DOCUMENTS

EP 2 482 275 B1 8/2012

OTHER PUBLICATIONS

International Search Report Issued Nov. 26, 2015 in PCT/EP14/075613 Filed Nov. 26, 2014.

*Primary Examiner* — Sean Kayes
(74) *Attorney, Agent, or Firm* — Oblon, McClelland, Maier & Neustadt, L.L.P.

(57) ABSTRACT

A striking mechanism is for a watch or music box that includes a vibration plate with optimized actuation energy. The striking mechanism includes a plurality of cantilevered strips. These strips are each made of a material of Young's modulus E and of density ρ satisfying the inequality:

$$\sqrt{\frac{E}{\rho^3}} < 0.25 \text{ m/s}.$$

All of the strips (2) each satisfy the relation:

$$\delta_{f,b,20\mu W}(L) = \left(\frac{8U}{b}\right)^{\frac{1}{2}}\left(\frac{3.515}{4\pi f}\right)^{\frac{3}{2}}\left[\frac{E}{(3\rho)^3}\right]^{\frac{1}{4}} L^{-\frac{3}{2}},$$

where b is the width, L the length, δ the travel, f the frequency and U the actuation energy of the strip, U being (Continued)

greater than or equal to 20 microwatts, and the strips (2) are arranged to vibrate between 800 Hz and 4000 Hz.

19 Claims, 3 Drawing Sheets

(51) Int. Cl.

| | |
|---|---|
| ***G04B 23/08*** | (2006.01) |
| ***G10F 1/06*** | (2006.01) |
| ***G10K 1/067*** | (2006.01) |

(56) References Cited

U.S. PATENT DOCUMENTS

| | | | | |
|---|---|---|---|---|
| 9,182,744 | B2 * | 11/2015 | Karapatis | G04B 23/026 |
| 2006/0162530 | A1 * | 7/2006 | Muramatsu | G10F 1/06 84/402 |
| 2012/0174725 | A1 * | 7/2012 | Huang | G10F 1/06 84/94.1 |
| 2012/0192697 | A1 | 8/2012 | Favre | |

* cited by examiner

STRIKING MECHANISM FOR A WATCH OR MUSIC BOX WITH A VIBRATION PLATE HAVING OPTIMISED ACTUATION ENERGY

This a National Phase Application in the United States of International Patent Application PCT/EP2014/075613 filed Nov. 26, 2014 which claims priority on European Patent Application No 13196157.5 filed Dec. 9, 2013. The entire disclosures of the above patent applications are hereby incorporated by reference.

FIELD OF THE INVENTION

The invention concerns a striking mechanism for a watch or music box comprising at least one vibration plate with optimised actuation energy comprising a plurality of cantilevered strips.

The invention also concerns a timepiece formed by watch or a music box including at least one such mechanism.

The invention concerns the field of timepieces comprising a striking mechanism, particularly watches and music boxes.

BACKGROUND OF THE INVENTION

The striking mechanism of musical watches or music boxes is generally formed by a vibration plate and a system of actuating the strips of the vibration plate. The actuation system may be a rotating cylinder or a rotating disc, or suchlike.

Until now, the material of the vibration plate has been selected mainly on the basis of manufacturability and resistance to wear and fatigue. This is because the strips of the vibration plate are subjected to repeated elastic forces and the friction between the surface of the strips and the actuation pins may either cause abrasion or calking of the surfaces. At the same time, until now, manufacturers of striking watches or music boxes have always attempted to increase as much as possible the actuation energy of the strips, which requires very high elastic forces, particularly for the shortest strips, which correspond to the highest pitched sounds.

EP Patent Application No 2482275A1 in the name of MONTRES BREGUET SA describes a vibration plate for a music box in the form of a watch, composed of a set of pairs of parallel strips, connected at one end thereof to a heel, each pair of strips forming a tuning fork, wherein one of the strips of the pair can be set in vibration by a pin of a musical movement, and the vibration propagates to the other strip of the pair via a longitudinal wave. In a particular variant, the vibration plate is made of precious metal, gold, or metallic glass.

SUMMARY OF THE INVENTION

The present invention proposes the introduction of an optimised vibration plate for a striking mechanism, made of a material having particular elastic properties, specifically to ensure optimum sound radiation through the external parts, and with a specific geometry for storing the maximum amount of energy in the smallest overall dimensions.

The energetic study of a vibration plate for a striking mechanism, which was undertaken to overcome this problem of optimising radiation, highlights the fact that the actuation energy must exceed a defined threshold (around 20 microwatts), slightly dependent on the external watch parts, to allow for efficient radiation and to obtain a strong improvement in the sound level (improvement of more than 10 dB around this threshold), but that there is no significant advantage in further increasing the actuation energy beyond this threshold. Indeed, beyond this threshold, the improvement becomes linear, which means that the available energy must be doubled to increase the level of sound produced by only 3 dB.

At the same time, nowadays, techniques for coating and hardening materials can reduce the risk of wear and fatigue for timepiece components, and make possible the use of relatively flexible materials for the striking mechanism vibration plate function.

This means that the material of the vibration plate can be selected on the basis of criteria of energy (all the strips must have an actuation energy of more than 20 microwatts) and the overall dimensions of the component.

The invention therefore proposes an unusual solution, quite contrary to industry practice, by defining an optimised striking mechanism vibration plate having both a lower modulus of elasticity than the steel vibration plates conventionally used and a higher density: the main example of this family of optimised vibration plates according to the invention are vibration plates made of gold or gold alloy.

Owing to the use of this material, or of other materials meeting the same physical conditions, it is possible to standardize the sound level of the notes played, while remaining within reduced overall dimensions: to obtain this optimum system a well-defined and adapted geometry must be used, set out in detail in the following description.

To this end, the invention concerns a striking mechanism for a watch or music box comprising at least one vibration plate with optimised actuation energy, comprising a plurality of cantilevered strips, characterized in that said strips are each made in a material of Young's modulus E and of density ρ satisfying the inequality $$\sqrt{\frac{E}{\rho^3}} < 0.25\frac{\mathrm{m}}{\mathrm{s}},$$

and in that all of said strips each satisfy the relation:

$$\delta_{f,b,U}(L) = \left(\frac{8U}{b}\right)^{\frac{1}{2}}\left(\frac{3.515}{4\pi f}\right)^{\frac{3}{2}}\left[\frac{E}{(3\rho)^3}\right]^{\frac{1}{4}} L^{-\frac{3}{2}}$$

where b is the width of said strip, L is the length of said strip, where δ is the travel of the strip, and f is the frequency of said strip, and where U is the actuation energy of said strip which is greater than or equal to 20 microwatts, and in that said strips are arranged to vibrate between 800 Hz and 4000 Hz.

According to a particular feature of the invention, the overall dimensions of said vibration plate are limited to an active length of said vibration plate of 12 mm, a width of said vibration plate of 7 mm, and a vertical height of said vibration plate of 1.5 mm.

According to another particular feature of the invention, said strips are each in a material of Young's modulus comprised between 70 GPa and 120 GPa, or said strips are each of density comprised between 14 and 22.

According to another particular feature of the invention, said strips are each in a material of Young's modulus comprised between 70 GPa and 120 GPa, and said strips are each of density comprised between 14 and 22.

More specifically, said vibration plate is made of a material of Young's modulus comprised between 70 GPa and 120 GPa, and said vibration plate is of density comprised between 14 and 22.

According to a particular feature of the invention, at least one of said strips is made of an alloy including gold.

The invention also concerns a timepiece formed by watch or a music box including at least one such mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
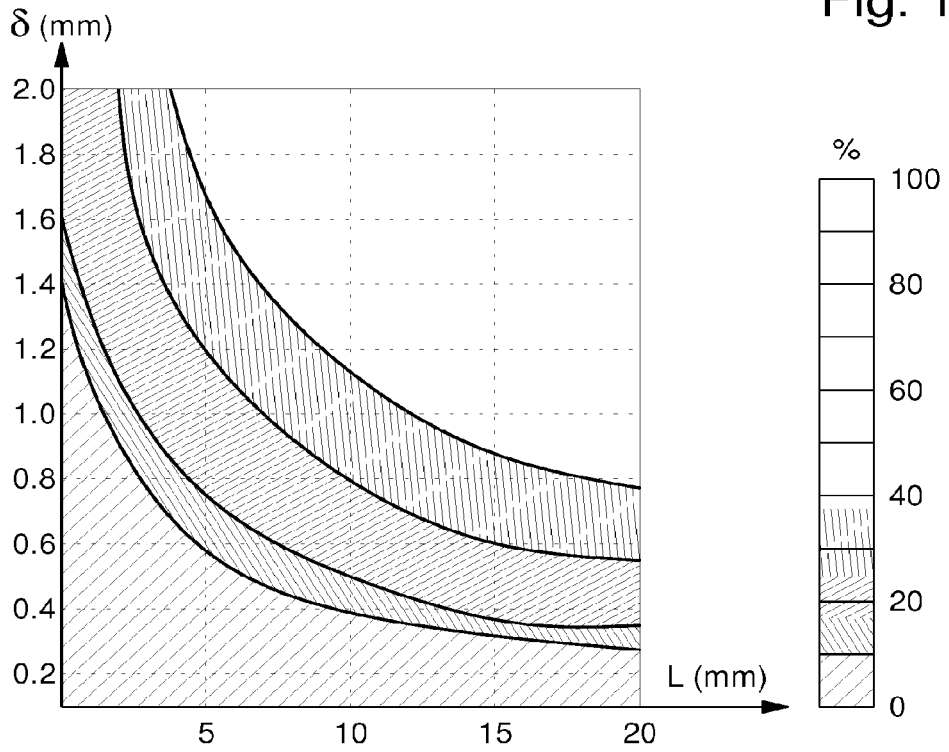
FIG. 1 shows a schematic view of the distribution of actuation energy (in microwatts) of a strip having a fundamental bending mode at 800 Hz, for a 750 gold vibration plate according to the invention (E=110 GPa, ρ=15100 kg/m$^3$), as a function of the strip length on the x-axis, and the lift of the strip on the y-axis, for a strip width of 0.4 mm.

The invention concerns the field of timepieces comprising a striking mechanism, particularly watches and music boxes.

More specifically, the invention concerns a vibration plate 1 for a striking mechanism of a watch 100 or music box 200, with optimised actuation energy, comprising a plurality of cantilevered strips 2.

Each of strips 2 is dimensioned to vibrate at a determined frequency. The entire vibration plate 1 is devised to ensure the generation of vibrations for radiation in a particular range of audible frequencies. More specifically but not limitatively, this range concerns the frequencies from 800 Hz to 4000 Hz; the conceptual thinking set out below applies to all other limit values of this frequency range.

Advantageously, according to the present invention, each strip 2 of vibration plate 1 is fabricated in a material wherein $$\sqrt{\frac{E}{\rho^3}} < 0.25 \text{ m/s}.$$

In a variant of the invention, these strips 2 of each made of a material M of Young's modulus comprised between 70 GPa and 120 GPa.

In another variant, at least one strip 2 is made of platinum or platinum alloy, and then has a Young's modulus greater than 120 GPa.

In a variant of the invention, these strips 2 are each of higher density than 14, and notably comprised between 14 and 22.

More specifically, these strips 2 are each made of a material of Young's modulus comprised between 70 GPa and 120 GPa, or strips 2 are each of density comprised between 14 and 22.

More specifically, these strips 2 are each made of a material of Young's modulus comprised between 70 GPa and 120 GPa, and strips 2 are each of density comprised between 14 and 22.

More specifically, the vibration plate is made of a material of Young's modulus comprised between 70 GPa and 120 GPa, or the vibration plate is of density comprised between 14 and 22.

More specifically, the vibration plate is made of a material of Young's modulus comprised between 70 GPa and 120 GPa, and the vibration plate is of density comprised between 14 and 22.

It is to be noted that "density" means here relative density with respect to water; thus, a density of value "λ" corresponds to a mass density of λ. 10$^3$ kg/m$^3$. The different shades of normal gold and gold alloys, particularly 18 carat "750" gold, satisfy this criterion.

In a variant of the invention, at least one strip 2 is made of an alloy including gold.

In a variant of the invention, at least one strip 2 is made of "750" gold comprising at least 75% gold.

Other materials satisfy the required conditions, and may be envisaged for the fabrication of a vibration plate according to the invention, used alone, or in combination with gold, or in combination with at least gold, or in combination with each other, or in a combination of at least two of such materials.

Thus, in a variant, vibration plate 1 includes at least one element from the group formed of:

- Tungsten
- Iridium
- Platinum
- Palladium
- Silver
- Copper
- Bronze
- Certain cast irons
- Glass
- Crystal
- Beryllium
- Chromium
- Manganese
- Molybdenum
- <<Invar®>>, <<Inconels®>>, <<Hastalloys®>> and similar elements
- Various carbides
- Zirconium oxide
- Sapphire, this at least one element being used alone, or in combination with gold, or in combination with at least gold, or in combination with another element of the group, or in a combination between at least two elements of the group.

More specifically, tungsten, iridium, platinum, palladium and silver may be used alone.

Each time it should be checked that the values of E and ρ respect the various criteria defined for the invention.

Figure 5:
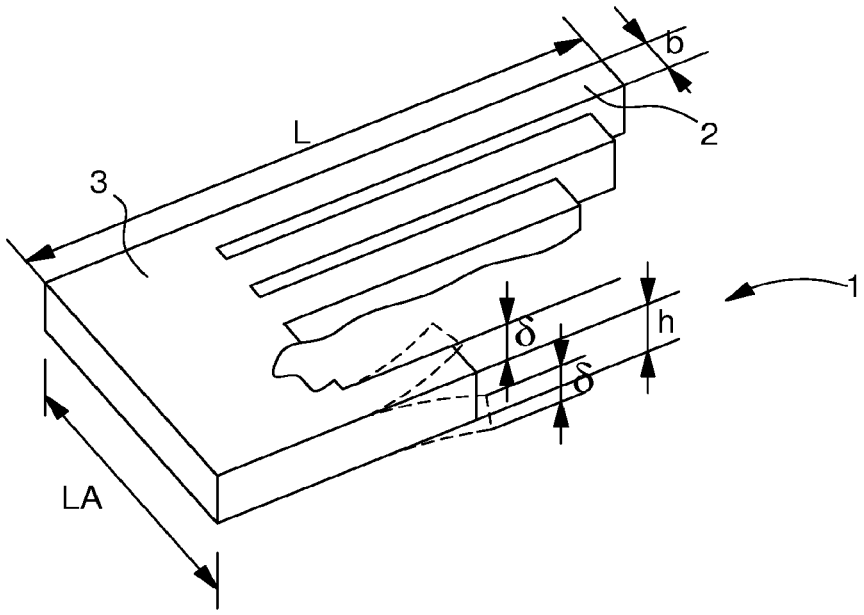
FIG. 5 is a schematic perspective view of a vibration plate according to the invention.

In a particular embodiment, as seen in FIG. 5, all of strips 2 which form vibration plate 1 form a one-piece assembly with a table 3 via which vibration plate 1 is secured. This table 3 forms the anchor heel of each strip 2, similar to a vibrating beam anchored at one end and mounted in a cantilever arrangement. In other variants that are not illustrated, vibration plate 1 may be formed with strips 2 that all conform to the Young's modulus and density value ranges according to the invention, and are each anchored in a table 3 which also preferably conforms to the same value ranges.

In the present description, for the sake of simplification, each strip 2 is a solid parallelepiped prism. In practice, the same reasoning is applicable to solid or hollow strips 2 of different shapes and sections.

In this specific example, for each specific material M, of Young's modulus E and of density ρ, the appropriate geometry of strips 2 (defined by the minimum length, the maximum length, the height h and the width b of the strips) is obtained mathematically using the two equations respectively defining the frequency and bending energy of a vibration plate strip (modelled as a thin beam anchored at one end):

$$f = \frac{3.515\,h}{4\pi L^2}\sqrt{\frac{E}{3\rho}}, \tag{1}$$

$$U = \frac{Ebh^3\delta^2}{8L^3}. \tag{2}$$

For a given material and frequency, the height h of strip 2 is determined by its length L:

$$h = \frac{4\pi f}{3.515}\sqrt{\frac{3\rho}{E}}\,L^2. \tag{3}$$

By introducing the relation (3) into (2), it is possible to obtain the actuation energy of each strip 2 (having the fundamental bending mode S) as a function of its length L and its travel δ (for a fixed width b):

FIG. 1 illustrates the actuation energy (in microwatts) of a strip having the fundamental bending mode at 800 Hz for a 750 gold vibration plate (E=110 GPa, ρ=15100 kg/m$^3$) as a function of the length L and travel δ of the strip, for a strip width b=0.4 mm.

For a given material, frequency, strip width and actuation energy, the sweep necessary to obtain actuation energy U=20 microwatts, is determined (in KO units) by the strip length L:

$$\delta_{f,b,u20\mu W}(L) = \left(\frac{8U}{b}\right)^{1/2}\left(\frac{3.515}{4\pi f}\right)^{3/2}\left[\frac{E}{(3\rho)^3}\right]^{1/4} L^{-3/2}. \tag{4}$$

If the maximum dimension at z is determined by $2\delta+h<H_{max}$ and the maximum dimension of the strips in the direction defined by their main axis is determined by $L<L_{max}$, equation (4) can unequivocally determine the optimum configuration.

For digital implementation, a strip width b=0.4 mm is used and the typical limit frequencies of a striking mechanism vibration plate are considered to be: $f_{min}$=800 Hz et $f_{max}$=4000 Hz.

Figure 2:
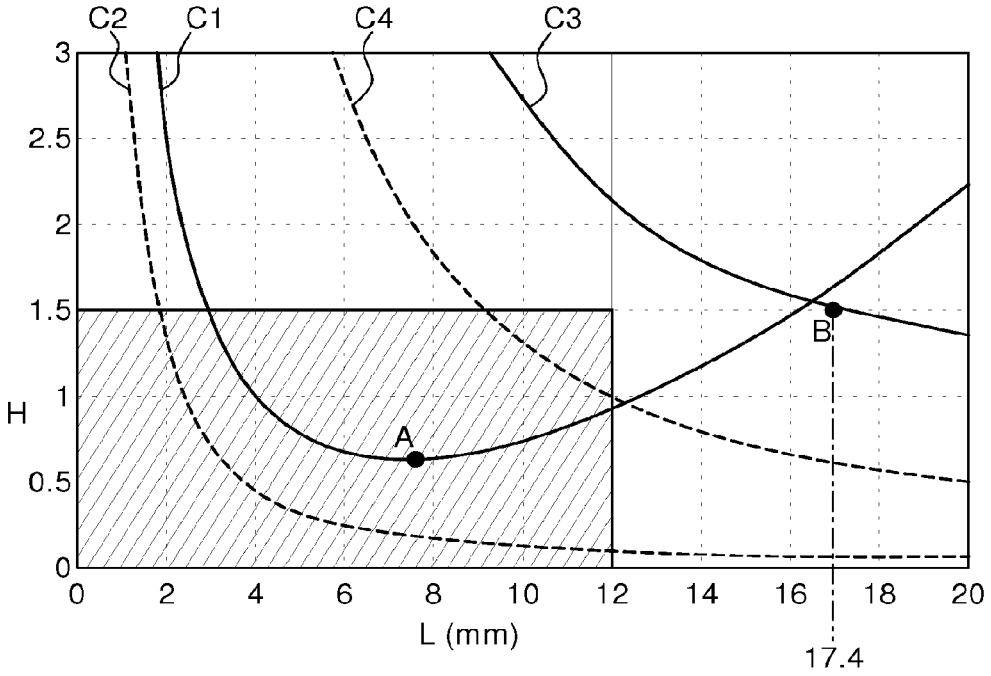
FIG. 2 shows a schematic diagram, for a steel vibration plate of the prior art, with the strip length on the x-axis, and the total vertical dimension of the strip on the y-axis, i.e. the total of its height and double its travel, which is evaluated to obtain an actuation energy of 20 microwatts; and the diagram shows the response of the vibration plate at certain frequencies (on the left side for a strip at 4000 Hz and on the right side for a strip at 800 Hz), each solid line curve corresponding to the response with the total vertical dimension, and each dotted line curve corresponding to the single travel, and wherein the maximum overall length of the strip and the total vertical dimension, characteristic of the operating limits, is represented by the shaded area.

For a vibration plate made of a steel with E=185 GPa and density 8000 kg/m$^3$, equation (4) produces the curves shown in FIG. 2, which illustrates the travel δ necessary to obtain an actuation energy U=20 microwatts, and the total vertical dimension (defined by the sum of the strip height plus two times the travel h+2δ) for a strip at 800 Hz and a strip at 4000 Hz, as a function of the strip length. The maximum dimension in length of the strip and total vertical dimension is represented by the shaded area. Graphs C1 and C2 represent the frequency of 4000 Hz, respectively with the total vertical dimension h+2δ or simply with travel δ. Graphs C3 and C4 are counterparts at a frequency of 800 Hz.

FIG. 2 is a diagram with a travel calculated to obtain an actuation energy of 20 microwatts, and shows the response of the vibration plate at certain frequencies (on the left side for a strip at 4000 Hz and on the right side for a strip at 800 Hz), each solid line curve corresponding to the response with the total vertical dimension, and each dotted line curve corresponding simply to travel δ. The maximum dimension in length of the strip and total vertical dimension, characteristic of operating limits, are represented by the shaded area. Outside this area, the vibration plate cannot be incorporated in a conventional wristwatch.

FIG. 2 therefore shows that, within the maximal allowable overall dimensions (here L is less than or equal to 12 mm, and the total maximum overall dimension is less than or equal to 1.5 mm), it is possible to actuate the strip at 4000 Hz with the required (or greater) energy: several geometries permit this result, for example a strip of length L=7.5 mm and height h=0.25 mm actuated with a travel δ=0.2 mm, corresponding to point A on solid line graph C2 of the frequency 4000 Hz. However, it is impossible for this vibration plate material to actuate a strip at 800 Hz with the required minimum energy within the allowable overall dimension, since curve C3 corresponding to the frequency of 800 Hz with the maximum overall dimension (continuous curve) does not pass through the area specific to the maximum overall dimension of the vibration plate. It is seen that a strip vibrating at 800 Hz and of the same total vertical dimension, i.e. at point B on graph C3, would require a length L of 17.4 mm.

In conclusion, within the conventional overall dimensions of a watch, a steel vibration plate cannot therefore actuate a strip with sufficient energy to obtain optimum acoustic radiation at all frequencies.

Figure 3:
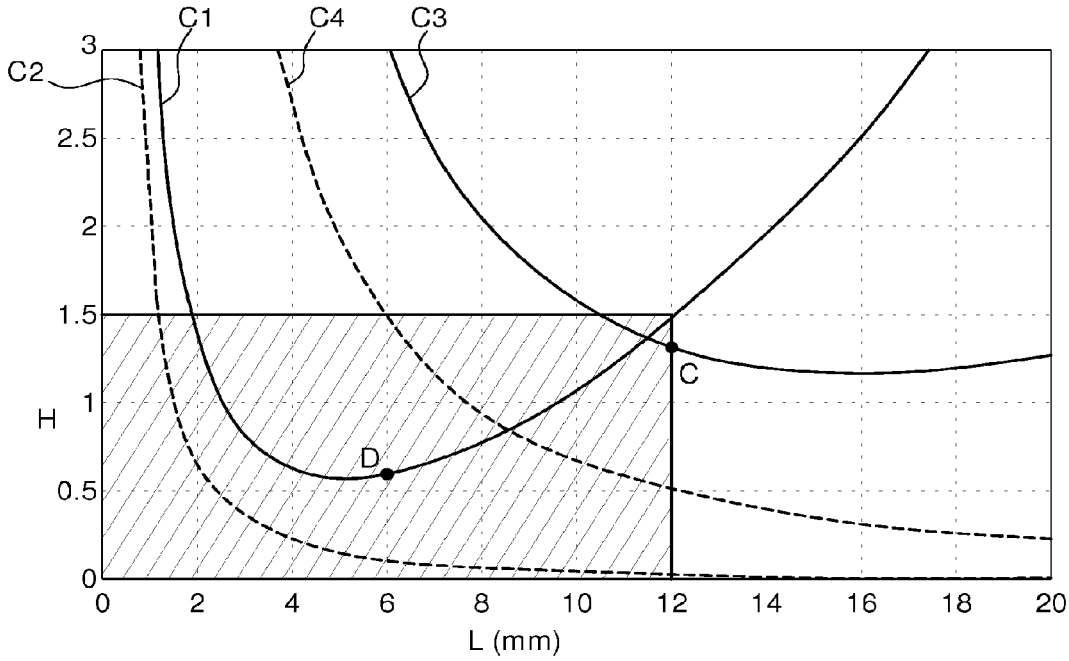
FIG. 3 shows, in a similar manner to FIG. 2, a diagram corresponding to a vibration plate according to the invention made of a first 750 gold alloy with a Young's modulus of 110 GPa and a density of 15.1.

For a vibration plate according to the invention, and particularly made of 750 gold, (with E=110 GPa, and ρ=15100 kg/m$^3$), equation (4) produces the curves shown in FIG. 3, which concerns a vibration plate 1 according to the invention made of 750 gold, with similar graphs to those of FIG. 2. It is seen that, in this case, it is also possible to actuate the strip at 800 Hz with sufficient energy while remaining within the desired dimension limits. It is therefore possible to actuate all the strips with the same energy: in one of the possible configurations, corresponding to point C on graph C3, the strip at 800 Hz has a length L=12 mm and a height h=0.3 mm actuated with a travel δ=0.5 mm, i.e. a maximum total overall dimension of 1.3 mm, whereas, at point D of graph C1 corresponding to the frequency of 4000 Hz, the corresponding strip 2 has a length L=6 mm and a height h=0.35 actuated with a travel δ=0.15 mm, i.e. a maximum total overall dimension of 0.65 mm.

A vibration plate 1 with 15 strips 2, separated in pairs by a gap of approximately 0.07 mm, having the physical characteristics defined by the invention (E comprised between 70 GPa and 120 GPa, and density comprised between 14000 kg/m$^3$ and 20000 kg/m$^3$), can still actuate all of strips 2 with an energy greater than 20 microwatts within an overall dimension (active length of the vibration plate× width of the vibration plate×vertical height) limited to (12 mm×7 mm×1.5 mm).

Figure 4:
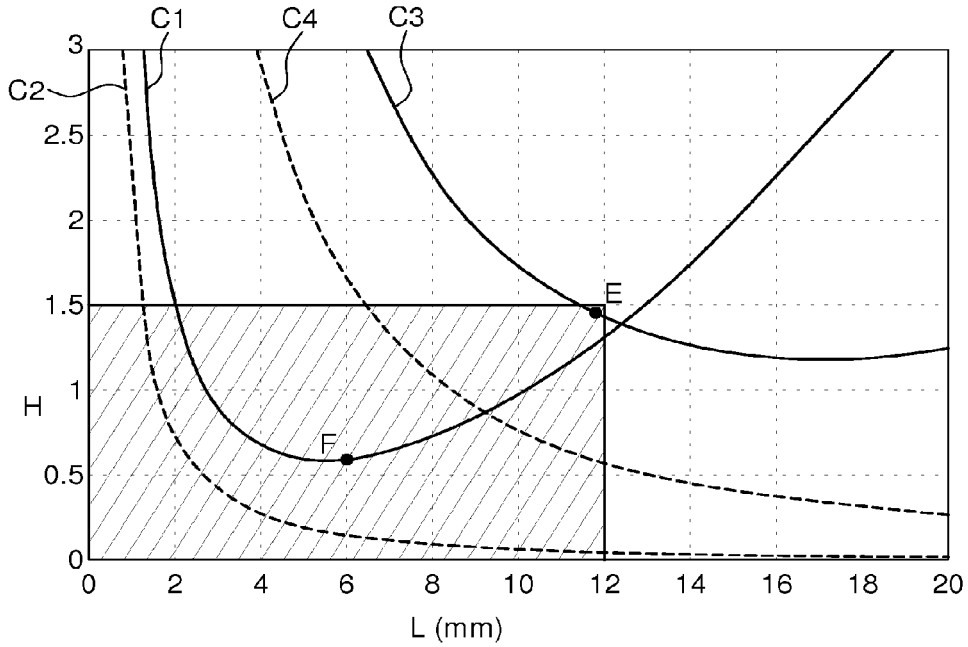
FIG. 4 shows, in a similar manner to FIG. 2, a diagram corresponding to a vibration plate according to the invention made of a second gold alloy with a Young's modulus of 120 GPa and a density of 14.0.

FIG. 4 shows curves defining the travel and vertical overall dimension for limit values (and therefore the most critical values) of the mechanical parameters (E=120 GPa, ρ=14000 kg/m$^3$). Even in this case, optimum dimensioning of the vibration plate is possible: graph C3 passes through the shaded area and, at point E on graph C3, a strip of length L=11.5 mm, and with a maximum overall height dimension of 1.45 mm, is suitable for the frequency of 800 Hz, while there is no difficulty in ensuring sound radiation at the frequency of 4000 Hz.

In short, the improvement compared to a steel vibration plate is made possible by the fact that the frequency and actuation energy of strip 2 according to the invention have a different functional dependence depending on the parameters and, particularly by the fact that with the same actuation energy:

$$\delta^2 L^3 = c \cdot \sqrt{\frac{E}{\rho^3}}. \tag{5}$$

where c=c (b, f) is a function that depends only on the width and frequency of the strip, and does not depend on either the length or the travel of strip 2.

More specifically, $\delta^2 L^3$ is proportional to $(E/\rho^3)^{1/2}$.

For a higher density and/or a lower modulus of elasticity than that of steel, it is thus possible to reduce either the required travel, or the length L of strips 2, or both dimensions simultaneously.

In a variant of the invention, at least one strip 2 includes a surface coating.

In a variant of the invention, at least one strip 2 includes a hardened surface with respect to its core.

The advantages provided by implementing the invention are significant:

- an increase in the acoustic level of the sound radiated by a watch or a music box in the frequency band between 1 kHz and 4 kHz;
- increased uniformity of the acoustic level perceived during the melody;
- a decrease in the overall dimensions of the sound generation components (vibration plate and disc).

The invention also concerns a striking mechanism 50 for a watch 100 or music box 200 comprising at least one such vibration plate 1

The invention also concerns a timepiece 500, formed by a watch 100 or a music box 200 including at least one such mechanism 50, and/or at least one such vibration plate 1.

The invention claimed is:

1. A striking mechanism for a watch or music box comprising at least one vibration plate with optimized actuation power, the striking mechanism comprising:

a plurality of cantilevered strips, each of said strips being made of a material of Young's modulus E and of density ρ satisfying the inequality $$\sqrt{\frac{E}{\rho^3}} < 0.25 \text{ m/s},$$

and all of said strips each satisfy the relation:

$$\delta_{f,b,U20\mu W}(L) = \left(\frac{8U}{b}\right)^{\frac{1}{2}} \left(\frac{3.515}{4\pi f}\right)^{\frac{3}{2}} \left[\frac{E}{(3\rho)^3}\right]^{\frac{1}{4}} L^{-\frac{3}{2}}$$

where b is a width of said strip, L is a length of said strip, where δ is a travel of the strip, and f is the frequency of said strip, and where U is an actuation power of said strip which is greater than or equal to 20 microwatts, wherein said strips are arranged to vibrate between 800 Hz and 4000 Hz, and wherein an overall dimension of said vibration plate is limited to an active length of said vibration plate of 12 mm, a width of said vibration plate of 7 mm, and a vertical height of said vibration plate of 1.5 mm.

2. The striking mechanism according to claim 1, wherein said strips are each made of a material of Young's modulus comprised between 70 GPa and 120 GPa, or said strips each have a density comprised between 14 and 22.

3. The striking mechanism according to claim 2, wherein said vibration plate is made of a material of Young's modulus comprised between 70 GPa and 120 GPa, and said vibration plate has a density comprised between 14 and 22.

4. The striking mechanism according to claim 1, wherein said strips are each made of a material of Young's modulus comprised between 70 GPa and 120 GPa, and said strips each have a density comprised between 14 and 22.

5. The striking mechanism according to claim 4, wherein said vibration plate is made of a material of Young's modulus comprised between 70 GPa and 120 GPa, or said vibration plate has a density comprised between 14 and 22.

6. The striking mechanism according to claim 1, wherein at least one of said strips is made of an alloy including gold.

7. The striking mechanism according to claim 6, wherein each of said strips of said vibration plate is made of an alloy including gold.

8. The striking mechanism according to claim 1, wherein said vibration plate is made of a material including platinum, either alone or in combination with at least gold.

9. The striking mechanism according to claim 1, wherein said vibration plate is made of a material including palladium, either alone or in combination at least with gold.

10. The striking mechanism according to claim 1, wherein said strips have a height of 0.25 mm actuated with a travel of 0.2 mm.

11. The striking mechanism according to claim 1, wherein said strips have a height of 0.35 mm actuated with a travel of 0.15 mm.

12. The striking mechanism according to claim 1, wherein said strips are separated in pairs by a gap of 0.07 mm.

13. The striking mechanism according to claim 1, wherein said strips have a width of 0.4 mm.

14. The striking mechanism according to claim 1, wherein at least one of said strips includes a surface coating.

15. The striking mechanism according to claim 1, wherein at least one of said strips includes a hardened surface with respect to a core thereof.

16. The striking mechanism according to claim 1, wherein at least one of said strips is hollow.

17. The striking mechanism according to claim 1, wherein all of the strips that form said vibration plate form a one-piece assembly with a table of said vibration plate.

18. A watch, comprising:

at least one striking mechanism according to claim 1.

19. A music box, comprising:

at least one striking mechanism according to claim 1.

* * * * *